US006980661B2

(12) United States Patent
Godfrey et al.

(10) Patent No.: US 6,980,661 B2
(45) Date of Patent: Dec. 27, 2005

(54) METHOD OF AND APPARATUS FOR PRODUCING APPARENT MULTIDIMENSIONAL SOUND

(76) Inventors: Mike Godfrey, B509, 44 Coconut Row, Palm Beach, FL (US) 33480; Antonio Nucaro, 210 Cochrane Drive, Unit 6, Markham, Ontario (CA)

( * ) Notice: Subject to any disclaimer, the term of this patent is extended or adjusted under 35 U.S.C. 154(b) by 314 days.

(21) Appl. No.: 09/987,217

(22) Filed: Nov. 14, 2001

(65) Prior Publication Data

US 2003/0091195 A1 May 15, 2003

(51) Int. Cl.[7] ..... H04R 5/00; H04R 1/02; H04R 5/02

(52) U.S. Cl. ..... 381/26; 381/91; 381/307

(58) Field of Search ..... 381/92, 91, 111–115, 381/122, 307, 361, 362, 363, 365, 366, 368, 381/356, 357, 358, 18–19, 300, 26, 119, 61

(56) References Cited

U.S. PATENT DOCUMENTS 5,630,175 A * 5/1997 Gajewski et al. ..... 710/72
5,673,327 A * 9/1997 Julstrom ..... 381/119
5,778,083 A * 7/1998 Godfrey ..... 381/92
6,198,826 B1 3/2001 Cowieson et al. ..... 381/18
6,236,730 B1 5/2001 Cowieson et al. ..... 381/18
RE38,350 E * 12/2003 Godfrey ..... 381/92

OTHER PUBLICATIONS

Sanyo Virtual Surround System IC LV 1150—OVERVIEW Jul. 1999 PS No. 6140 p. 1-9.
Spatializer N-2-2 Digital Virtual Surround System OVERVIEW Web page publication, believed to have been published in 2001.
InMotion 3D Audio Producer OVERVIEW Web page publication, p. 1-3, believed to have been published in 2001.
Dolby Laboratories Information Virtual Surround Reproduction believed to have been published in 2001.
3D Audio and Acoustic Environment Modeling—William G. Gardner Wave Arts, Inc.—Mar. 15, 1999 OVERVIEW.
ZORAN—Virtual 3-D Overview Michael Neidich, Product Manager—Audio Product Team believed to have been published in 2001.

* cited by examiner

*Primary Examiner*—Laura A. Grier
(74) *Attorney, Agent, or Firm*—McFadden, Fincham

(57) ABSTRACT

The production of multidirectional or instantaneous live virtual surround sound broadcasting is obtained by positioning a plurality of microphones on an oval frame in a predetermined pattern and with a predetermined orientation, connecting the microphones to a virtual surround semiconductor chip and connecting outputs from the semiconductor chip to a pair of speakers.

16 Claims, 2 Drawing Sheets

METHOD OF AND APPARATUS FOR PRODUCING APPARENT MULTIDIMENSIONAL SOUND

FIELD OF INVENTION

The present invention relates to the production of multidimensional sound and in particular to the production of apparent multidimensional sound, using multiple microphones, a "virtual sound" semiconductor chip and two speakers.

BACKGROUND OF THE INVENTION

It has been proposed to produce multidimensional sound by using a plurality of microphones, five or more, connected to a semiconductor chip, conveniently referred to as a "virtual surround" chip, the outputs from the chip connected through "sensors" to two spaced speakers remote from the listener. Various sources of "virtual surround" chips and processors exist, with varying quality results.

SUMMARY OF THE PRESENT INVENTION

The present invention is concerned with the use of a specialized chip or circuit, with inputs from a plurality of microphones arranged in a particular pattern. The outputs from the chip or circuit are fed to at least two channels, left and right, without physical or "hands-on" mixing or other treatment, to produce what appears to be multidimensional or "surround" sound. A conventional interface is used between the microphones and the chip or circuit, which can provide amplification, and some voltage control if desired.

The invention is applicable to using the normal two channels with speakers, spaced from the listener and also to other forms of channels with speakers such as headphones.

Typically, output from six or seven microphones are fed to the chip or circuit, with two outputs from the chip.

Thus, in accordance with the present invention, multidirectional or "virtual surround" sound is produced by apparatus comprising a multiple microphone system having an oval portable frame and a plurality of linear pick-up pattern microphones lying within a plane and mounted on said frame, each microphone having a diaphragm facing outwards, the diaphragms positioned on a non-circular generally elliptical figure when viewed in a direction perpendicular to said plane, a "virtual surround" semiconductor chip having a plurality of inputs connected individually to said microphones, and means connecting two outputs from said "virtual surround" semiconductor chip to a pair of speakers.

Conveniently, an interface can connect the microphone outputs to the "virtual surround" semiconductor chip, the interface providing amplification of the microphone outputs. The interface can also provide some voltage control of the microphone outputs.

The invention is particularly applicable in "Instantaneous Live Broadcasting" or what is perhaps more correctly called "Instantaneous Live Virtual Surround Sound Broadcasting".

In an alternative embodiment, the "virtual surround" chip is replaced by suitable sound processing means including integrated circuits or chips, which may include conventional or suitable algorithms for creating 3D sound simulation.

DETAILED DESCRIPTION OF THE INVENTION

Figure 1:
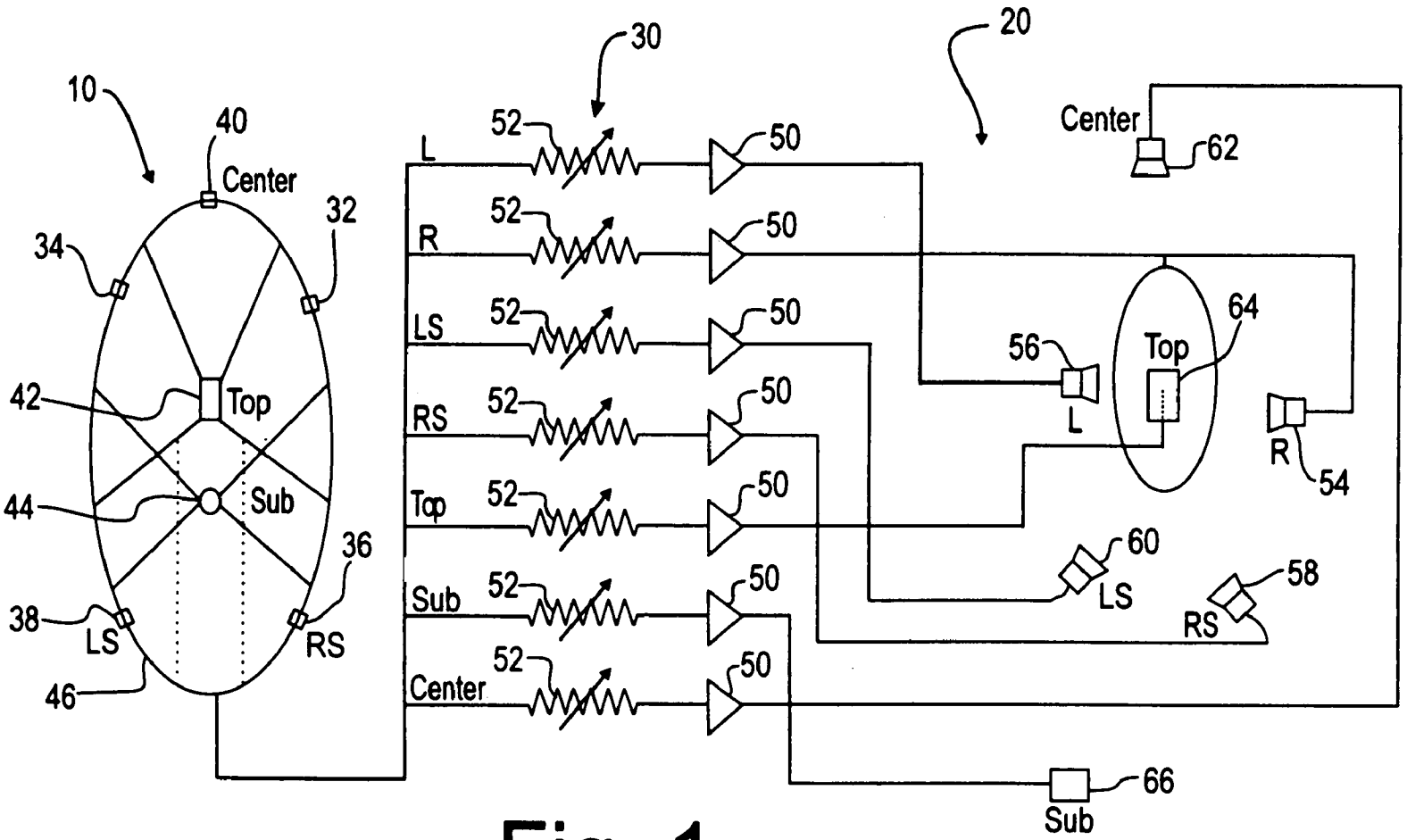
Fig. 1 PRIOR ART
FIG. 1 is a diagrammatic circuit for a known arrangement for "surround sound"

Considering FIG. 1, this illustrates diagrammatically a known arrangement, in which a multiple microphone arrangement, indicated generally at 10, is connected to a corresponding multiplicity of speakers indicated generally at 20 through an interface 30.

The microphone arrangement is one described and claimed in U.S. Pat. No. 5,778,083. It comprises, in the example illustrated, a combination of seven microphones, right microphone (R) 32, left microphone (L) 34, right side (RS) microphone 36, left side (LS) microphone 38, center microphone 40, top microphone 42, and a base or subwoofer (sub) microphone 44. The arrangement comprises a portable frame 46 defining a perimeter with a plurality of linear pick-up pattern microphones 32, 34, 36, 38, 40 lying within a plane and mounted on frame 46, each microphone including a diaphragm facing outwards. A further microphone, top microphone 42, is mounted on and above the frame and a further bottom or sub microphone is mounted on, below or inside the frame. The frame 46 is an oval shape with the diaphragms of the microphones on a non-circular generally elliptical figure when viewed in a direction perpendicular to the frame. Further description of the microphone arrangement can be obtained from the above mentioned U.S. Pat. No. 6,236,730, the disclosure of which is included herein by specific reference. In use, the frame 46 extends in a generally horizontal plane.

The outputs from the microphones are fed individually via the interface 30 to the speakers 20. The interface, of conventional form, comprises amplifiers 50, and can also include variable resistors 52 for voltage control.

From the interface 30, individual connections extend to, in the example, seven speakers: right speaker (R) 54, left speaker (L) 56, right side (RS) speaker 58, left side (LS) speaker 60, center speaker 62, top speaker 64 and a subwoofer speaker (sub) 66. The use of the particular microphone arrangement provides a very high quality level of "surround sound". However the requirement for a relatively large number of speakers results in an expensive and unwieldy system.

Figure 2:
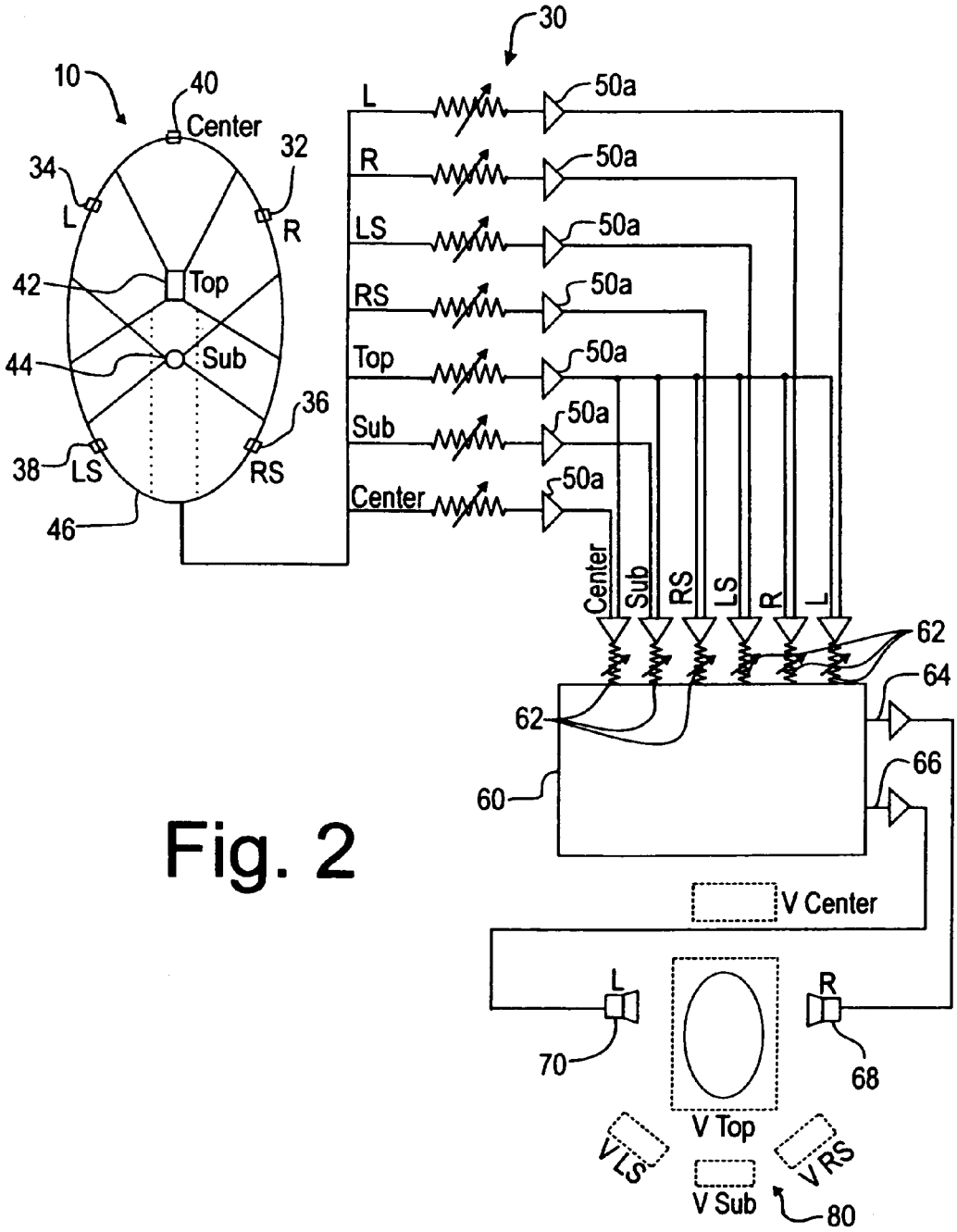
FIG. 2 is a diagrammatic circuit in accordance with the invention.

FIG. 2 illustrates diagrammatically the use of the microphone system 10, as in FIG. 1, with a known form of "virtual sound" semiconductor chip 60. Common reference numerals are used where applicable. A suffix (a) has been used in relation to the interface in that it is of the same form as that in FIG. 1, although some variations can occur. The interface 30(*a*) is again of conventional form.

The interface 30(*a*) connects the output from the seven microphones to six inputs of the "virtual surround" semiconductor chip 60. A typical example of chip 60 is one referred to as a Qsound chip—manufactured by Qsound Labs Inc., and described in U.S. Pat. No. 6,236,730. Other manufacturers also produce such chips under differing names and therefore such chips are referred to herein as virtual surround chips. Other suitable chips or circuits are discussed in greater detail below. It will be seen that the right, left, right side, left side, center and sub microphones connect individually to corresponding inputs to the chip, illustrated at 62, while a common connection is made from the top microphone to all inputs 62.

Outputs 64 and 66 are connected to speakers 68 and 70, right and left speakers, respectively.

The use of the particular arrangement of microphones provides a much higher quality level of "surround sound" or "virtual surround", than previously obtainable, and is obtained without the use of mixers and other additional items. The "virtual surround" effect appears to provide what are referred to as "virtual speakers" at 80 and identified as V RS, V LS, V top, V center, and V sub. These are not actual speakers but the listener has the sensation of such speakers existing.

As mentioned above, as distinct from a previous arrangement of multiple microphones, "virtual surround sound" chip and two speakers, the present invention, as in FIG. 2, is applicable to normal stereo speakers, spaced from the listener, and also to other forms of stereo speakers such as headphones. The use of the specialized input arrangement of microphones, the "virtual sound" chip provides a highly improved quality output, giving an improved "virtual surround" effect, not only with two normal speakers, spaced from the listener, but also with other forms of speakers such as headphones. As stated, the present invention is applicable to "Instantaneous Live Virtual Surround Sound Broadcasting". Basically, with the use of the present invention, there is provided an arrangement for inputting multiple channels live and simultaneously outputting in virtual surround sound on two-channel networks.

As noted herein, the "virtual surround sound" chip is only one example of a semiconductor chip which may be used with the present invention. In an alternative embodiment, other suitable means such as chips, DSP semiconductors, circuits or the equivalent, for processing decoded signals may be utilized in the present invention to convert or down-mix the signals (from a plurality of channels to two channels), for accurate simulation of "surround sound". Similarly, digital signal processing means may also be utilized with the present invention.

Suitable "virtual surround" processing chips or circuits are available from various manufacturers, such as a virtual surround circuit from Dolby as disclosed in the Dolby Laboratories Publication entitled "Virtual Surround Reproduction", believed to have been published in 2001, the contents of which are incorporated by reference.

Suitable software and data processing units, for example conventional computers, may also be used to down-mix or convert a plurality of channels format recordings to two channel formats. Such software or sound processing and encoding are available from Human Machine Interfaces using an "InMotion 3D Audio Producer" as described in the Human Machine Interface document entitled "InMotion 3D Audio Producer", believed to have been published in 2001, the contents of which are incorporated herein by reference.

Other suitable "virtual surround" integrated circuits include a "virtual surround" system Bi-CMOS IC able to create audio ambience equivalent to that of multichannel systems by adding a signal to which virtual surround processing has been applied to left and right channel input signals. For example, a suitable system is provided by Sanyo (™), with their virtual surround system IC, namely the LV1150 as described in the Sanyo Electric Co., Ltd., Semiconductor Company Publication No. 6140-1/9 entitled "LV1150 Virtual Sound System IC, the contents of which are incorporated by reference.

Other suitable algorithms may be utilized in the present invention, such as algorithms which are adapted to provide realistic multi-channel simulations, for example those developed by Spatializer Audio Laboratories and described in their publication entitled Spatializer-2-2, believed to have been published in 2001, the contents of which are incorporated herein by reference.

Suitable Virtual 3D surround processors may also be used in the present invention, such as those processors utilizing algorithms able to decode, for example, Dolby 5.1 serial data into 5.1 individual channels, process the signals and combine the signals into two outputs for, i.e., left and right, speakers. Suitable processors utilizing suitable algorithms are described in the Zoran Corporation publication, believed to have been published in 2001, entitled "Virtual 3-D Overview" which includes a description of a suitable decoder/processor, the contents of which are incorporated by reference.

Suitable 3D audio and acoustic environment modeling technology may also be utilized with the present invention, such as described in the 1999 paper of William G. Gardner entitled "3D Audio and Acoustic Environment Modeling" by Wave Arts, Inc., the contents of which are incorporated by reference.

The above embodiments are for illustrative purposes only, and as such various modifications are possible without departing from the scope and spirit of the invention. For example, as noted above, various sound processors could be used, as well as processors which can be adapted for use with various types of media and speaker installations.

We claim:

1. In an apparatus for producing instantaneous live virtual surround sound broadcasting, comprising a microphone system having a portable frame and at least five microphones including centre, left, right, left side and right side microphones, said microphones lying within a plane and mounted on said frame, each microphone having a diaphragm facing outwards, the diaphragms positioned in a non-circular generally elliptical figure when viewed in a direction perpendicular to said plane, each microphone having an output, a sound processor having a plurality of inlets, an inlet for each of said outputs of said microphones;

connection means connecting each of said at least five microphones to said inlets of said sound processor;

said sound processor having two outputs, and connection means connecting said two outputs individually to two speakers.

2. Apparatus as claimed in claim 1, said connection means connecting the outputs from the microphones to the sound processing means includes an interface, said interface including amplification means.

3. Apparatus as claimed in claim 1, said connection means connecting the outputs from the microphones to said sound processing means comprising an interface, said interface including voltage control means.

4. Apparatus as claimed in claim 1, said microphone system further including top and bottom microphones.

5. Apparatus as claimed in claim 1, wherein said sound processing means is a "virtual surround" semiconductor chip.

6. Apparatus as claimed in claim 1, wherein said sound processing means is a DSP semiconductor.

7. Apparatus as claimed in claim 1, wherein said sound processing means is connectable with data processing means whereby "surround sound" is created mathematically.

8. Apparatus as claimed in claim 7, wherein said data processing means includes real time processing algorithms.

9. In a method of producing apparent multi-directional sound, the improvement comprising connecting individual outputs from at least five microphones to individual inputs of a sound processing means, the microphones mounted on a portable frame, the microphones lying within a plane and each having a diaphragm facing outwards and with the diaphragms positioned in a non-circular generally elliptical figure when viewed in a direction perpendicular to said plane; and connecting two outputs from said sound processing means individually to two speakers.

10. In a method of producing instantaneous live virtual surround sound broadcasting, the improvement comprising connecting outputs individually from at least five microphones, including center, left, right, left side and right side microphones, to a plurality of separate individual inputs of a sound processing means, said center, left, right, left side, and right side, microphones mounted on a portable frame, the microphones lying in a plane and each having a diaphragm facing outwards in a non-circular generally elliptical figure when viewed in a direction perpendicular to said plane, connecting two outputs of said sound processing means individually to two speakers.

11. A method as claimed in 9, including connecting said outputs from said microphones to said sound processing means through an interface.

12. A method as claimed in claim 9, including variably controlling said inputs at said interface.

13. A method as claimed in claim 9, including amplifying said inputs at said interface.

14. A method as claimed in claim 10, including connecting said outputs from said microphones to said sound processing means through an interface.

15. A method as claimed in claim 10, including variably controlling said inputs at said interface.

16. A method as claimed in claim 10, including amplifying said inputs at said interface.

* * * * *

UNITED STATES PATENT AND TRADEMARK OFFICE

CERTIFICATE OF CORRECTION

PATENT NO. : 6,980,661 B2
APPLICATION NO. : 09/987217
DATED : December 27, 2005
INVENTOR(S) : Mike Godfrey and Antonio Nucaro It is certified that error appears in the above-identified patent and that said Letters Patent is hereby corrected as shown below:

On the title page item [60], should read: Provisional Serial No. 60/248,225, filed on November 15, 2000, Signed and Sealed this Nineteenth Day of February, 2008

JON W. DUDAS
*Director of the United States Patent and Trademark Office*